US011142432B2

(12) United States Patent
Oswald

(10) Patent No.: US 11,142,432 B2
(45) Date of Patent: Oct. 12, 2021

(54) SAFETY LOAD HOOK

(71) Applicant: pewag austria GmbH, Kapfenberg (AT)

(72) Inventor: Bernhard Oswald, Kapfenberg (AT)

(73) Assignee: pewag austria GmbH, Kapfenberg (AT)

( * ) Notice: Subject to any disclaimer, the term of this patent is extended or adjusted under 35 U.S.C. 154(b) by 6 days.

(21) Appl. No.: 16/786,865

(22) Filed: Feb. 10, 2020

(65) Prior Publication Data

US 2020/0255265 A1 Aug. 13, 2020

(30) Foreign Application Priority Data

Feb. 12, 2019 (DE) ..... 10 2019 103 517.1

(51) Int. Cl.
*B66C 1/36* (2006.01)

(52) U.S. Cl.
CPC ..... *B66C 1/36* (2013.01)

(58) Field of Classification Search
CPC ..... B66C 1/36; F16B 45/02
USPC ..... 294/82.17, 82.2, 82.22, 82.33
See application file for complete search history.

(56) References Cited

U.S. PATENT DOCUMENTS 731,162 A * 6/1903 Carter
1,514,781 A * 11/1924 Muse ..... B66C 1/00 294/82.33
1,520,576 A * 12/1924 Keaton ..... B66C 1/36 294/82.2
2,027,376 A * 1/1936 Grau ..... E21B 19/04 294/82.2
2,705,357 A * 4/1955 Davick ..... B66C 1/36 294/82.2
3,940,173 A * 2/1976 Ulbing ..... B66C 1/36 294/82.21
4,309,052 A * 1/1982 Drayton ..... B66C 1/36 24/599.5
4,471,511 A * 9/1984 Phipps ..... B63B 23/58 24/601.5
4,977,647 A * 12/1990 Casebolt ..... B66C 1/36 24/599.5

(Continued)

FOREIGN PATENT DOCUMENTS

CA 2 489 760 A1 6/2005
DE 2 425 867 A1 12/1974

(Continued)

*Primary Examiner* — Dean J Kramer
(74) *Attorney, Agent, or Firm* — Christensen, Fonder, Dardi & Herbert PLLC

(57) ABSTRACT

A safety load hook with a lower part having a hook throat to which a pivotable upper part is fastened, which, in an open position, allows a load to be suspended on the hook throat and, in a closed position, blocks the hook throat. The upper part is blockable in the closed position by a locking arrangement which includes a locking lever that is pivotable into a release position and a locked position, is pre-tensionable into the locked position by a tensioning spring, is fastened to the lower part with the tensioning spring via the support bolt and, in the locked position, engages in a receiver on the upper part by way of a shaped projection. The locking lever includes a lever on its side opposite the shaped projection, with a center of mass on the lateral surface of the receiving bore for the support bolt.

6 Claims, 3 Drawing Sheets

(56) References Cited

U.S. PATENT DOCUMENTS

2005/0127695 A1 6/2005 Cranston et al.

FOREIGN PATENT DOCUMENTS

| | | | |
|---|---|---|---|
| DE | 10 2007 027 746 | A1 | 12/2008 |
| EP | 0 080 955 | A1 | 6/1983 |
| EP | 0 085 631 | A1 | 8/1983 |
| FR | 2 491 901 | A3 | 4/1982 |
| GB | 1 430 543 | A | 3/1976 |
| JP | H09-67079 | A | 3/1997 |
| SE | 8500447 | L | 8/1986 |

* cited by examiner

SAFETY LOAD HOOK

PRIORITY CLAIM

The present application claims priority to German Patent Application No. 10 2019 103 517.1, filed on Feb. 12, 2019, which said application is incorporated by reference in its entirety herein.

FIELD OF THE INVENTION

The invention relates to a safety load hook having a lower part, which realizes a hook throat and to which an upper part is fastened so as to be pivotable by means of a connecting bolt, which bottom part, which is pivotable in relation to the lower part, allows a load to be suspended on the hook throat in an open position and, in a closed position, blocks the hook throat of the lower part outwardly such that the introduction of a load to be received in the hook throat or the removal of a load held there from said hook throat is prevented.

BACKGROUND OF THE INVENTION

Safety load hooks are load hooks which are designed such that in the closed position of the load hook, the hook throat of the lower part is blocked completely or almost completely (with a remaining small opening gap of up to 3 mm according to EN 818-6) and is held in said closed position by a locking arrangement. Unintentional release of a received load or of another element received in the hook is consequently prevented.

In this case, the locking system has first to be released for the open position of the lower part in order to be able to rotate the upper part and, as a result, to be able either to remove the received load from the hook mouth or to suspend the load to be received in the hook mouth.

The locking arrangement, in this case, can consist of a locking lever, a spring which holds said locking lever in a locked position and a support bolt, by way of which the locking lever and the spring are connected to the hook lower part.

Such an arrangement has largely shown itself to be safe up to now. However, it has certainly been shown in practice that under certain circumstances said arrangement can ultimately fail, namely in the following cases:

If, due to an incorrect application, and too much force acts on the upper part, it is possible in the locked position for the bolt of the locking lever to shear off on account of the lever action then acting on it. The locking action is then cancelled and the desired secure connection between the load hook and its load is no longer guaranteed.

In addition, if the load hook knocks against an object dynamically in almost a vertical direction, it is also possible for the locking action to be cancelled and the upper part to be able to open. This happens if, on account of the dynamics of the operation, the weight of the locking lever results in such a large amount of inertia that it overcomes the force of the pretensioning spring and the locking lever opens, as a result of which, once again, the upper part is subsequently released.

The safety load hook from DE 10 2007 027 746 A1 provides a hook which is pivotable in its entirety and can be moved into a closed position and an open position. In the closed position, the hook is held in a positive locking manner via a blocking element which is latchable into a latching recess and, in turn, is able to be released via remote control, wherein the hook itself is pretensioned toward its release position via a spring. In the case of said load hook, it is not possible for the disadvantages stated further above to arise on account of the overall arrangement chosen but using remote control is expensive.

In the case of the load hook design according to CA 2 489 760 A1, the load hook is also locked locally by remote control in its closed carrying position by means of a locking member which is mounted in the housing of the lifting device, wherein, when it is not situated in its carrying position, it is pretensioned toward a pivoted-open position by means of spring tension. Here too, it is also possible for the locking to be cancelled if the load hook is knocked against an object as in the case of incorrect use of the load hook with too great a force on the upper part. The installation of remote control unit for the locking system is certainly quite costly.

SUMMARY OF THE INVENTION

Proceeding from here, the invention seeks to propose a load hook of the type named in the introduction where the undesirable unlocking of the locking lever named further above in the case of incorrect application of an excessive force on the upper part of the safety load hook or in the case of the safety load hook being knocked downward dynamically against an object in an almost vertical direction is avoided without using a remote-controlled locking system.

This is achieved according to the invention by a safety load hook of the type named in the introduction where, in the closed position, the upper part is blockable in relation to the lower part by means of a locking arrangement which includes a locking lever with a receiving bore, which locking lever is pivotable about a support bolt arranged in said bore into a release position and into a locked position, is pretensionable into the locked position by means of a tensioning spring, is fastened to the lower part via the support bolt by way of the tensioning spring and engages by way of a shaped projection in an associated shaped receiving means on the upper part in the locked position, wherein the locking lever is realized on its side opposite the shaped projection with reference to the receiving bore with a lever portion in such a manner that the center of mass of the locking lever lies substantially on the lateral surface of the receiving bore for the support bolt or inside the cross sectional surface surrounded by the same, and the locking lever is supported on the lower part in the locked position via the free end of its lever portion.

In an embodiment, in this case, the center of mass of the locking lever lies on the center axis of the receiving bore for the support bolt.

In the case of the safety load hook according to the invention, a locking lever is now used which is realized with a lever portion on its side opposite the shaped projection with reference to the receiving bore in such a manner that the center of mass of the locking lever comes to lie substantially on the lateral surface of the receiving bore for the support bolt or inside the cross sectional surface surrounded by the same, consequently directly or almost in the pivot point of the locking lever. This prevents unwanted release of the locking arrangement if the load hook knocks against an object dynamically more or less in the vertical direction, because, in this case, practically no opening torque or only a very small opening torque acts on the locking lever as a result of the inertia that becomes free in the case of a knock without there being any risk, in this case, of the force of the pre-tensioning spring being overcome in an unwanted manner.

At the same time, in addition, in the case of the safety load hook according to the invention, on the side opposite the shaped projection with reference to the receiving bore of the locking lever, the lever portion provided there is also still realized such that the locking lever is supported on the lower part via the free end of the lever portion in its locked position and consequently, if incorrect use occurs with excessive force on the tip of the upper part of the load hook, unwanted shearing off of the support bolt of the locking lever is prevented as a result of the locking lever being supported against the lower part.

If, according to the claim, the center of mass of the locking lever is able to lie not only inside the cross sectional area surrounded by the lateral surface of the receiving bore for the support bolt but also "substantially" on the lateral surface of the receiving bore, this should then take account of the fact that a realization with a center of mass precisely on the lateral surface is often not achieved in an exact manner in practice on account of the tolerance deviations in the form of the locking lever which mostly occur inevitably during production of such locking levers, if only small, so that, as a result, a slight deviation of the position of the center of mass of the locking lever a little outside the cross section surrounded by the lateral surface should also be included.

A particularly preferred design of the invention also consists in that the lever portion of the locking lever is provided with a recess, inside which the tensioning spring is held securely in its assembly position, which facilitates assembly in a considerable manner and makes the often necessary use of an assembly aid for mounting the tensioning spring in the assembly position unnecessary.

It is additionally advantageous in the case of the invention when the lever portion of the locking lever, in the locked position thereof, is supported on the lower part on a correspondingly associated counter surface via a substantially rectilinear or only slightly convexly curved end portion on its free end, as a result of which the locking lever is supported in a particularly effective manner on the lower part compared to the case of a rounded or punctiform support point.

The recess of the lever portion is preferably also delimited on both sides of the lever portion by a side flank thereof in each case for receiving the tensioning spring, as a result of which a pocket-like recess for the tensioning spring which is simple to produce is created.

In an embodiment, in the case of the safety load hook according to the invention, the locking lever is also realized such that its center of mass is present centrally between said two side flanks of the lever portion.

BRIEF DESCRIPTION OF THE DRAWINGS

The invention is explained in more detail below, in principle as an example, by way of the drawings, in which.

DETAILED DESCRIPTION

Figure 1:
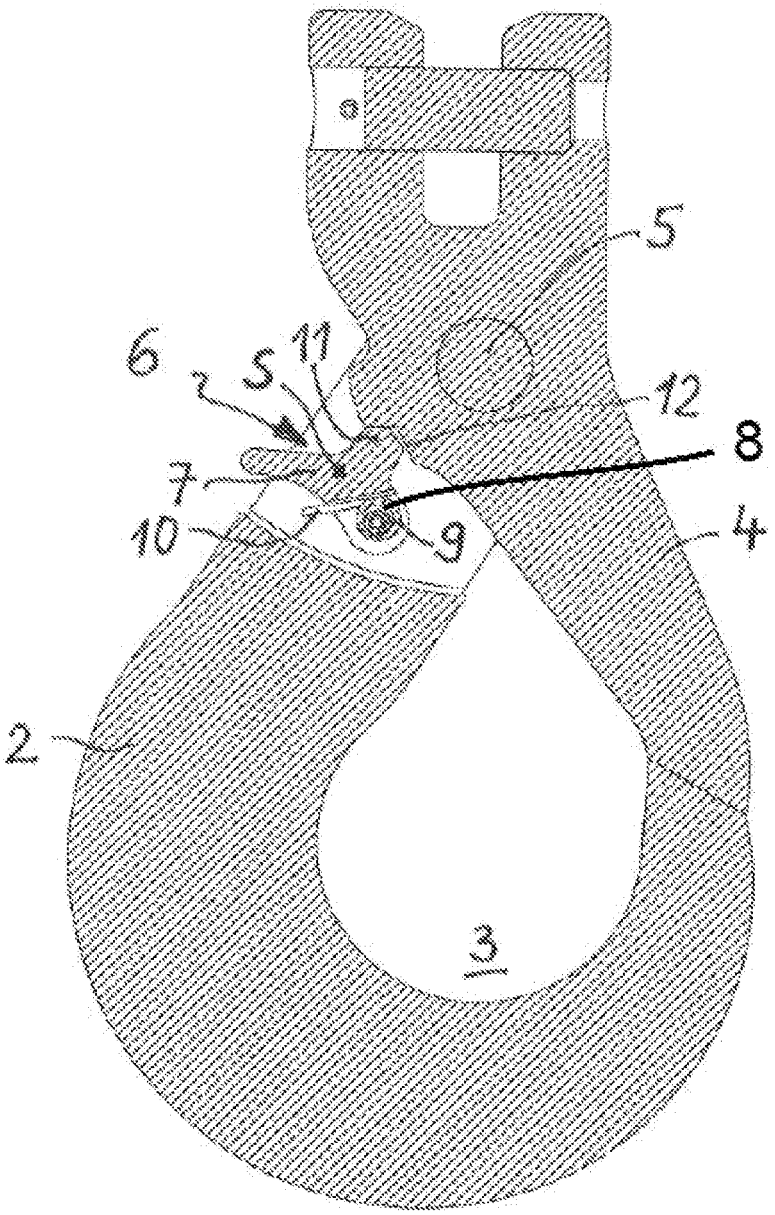
FIG. 1 Prior Art
FIG. 1 shows a center section of a safety load hook disclosed in the prior art.

FIG. 1 shows a center cross section of a safety load hook as disclosed in the prior art, whilst the representations in FIGS. 2 to 6 show an exemplary embodiment of a load hook according to the invention, the description of the disclosed load hook according to FIG. 1 being helpful to understanding the exemplary embodiment of a safety load hook according to the invention depicted in FIGS. 2 to 6.

In all the figures which are described below, identical parts are always provided with the same reference symbols.

All the figures show a safety load hook 1 which comprises a lower part 2 which provides a hook throat 3 for the suspending of a load (which is not shown in all the figures) so that it can be conveyed by way of the safety load hook 1.

Figure 3:
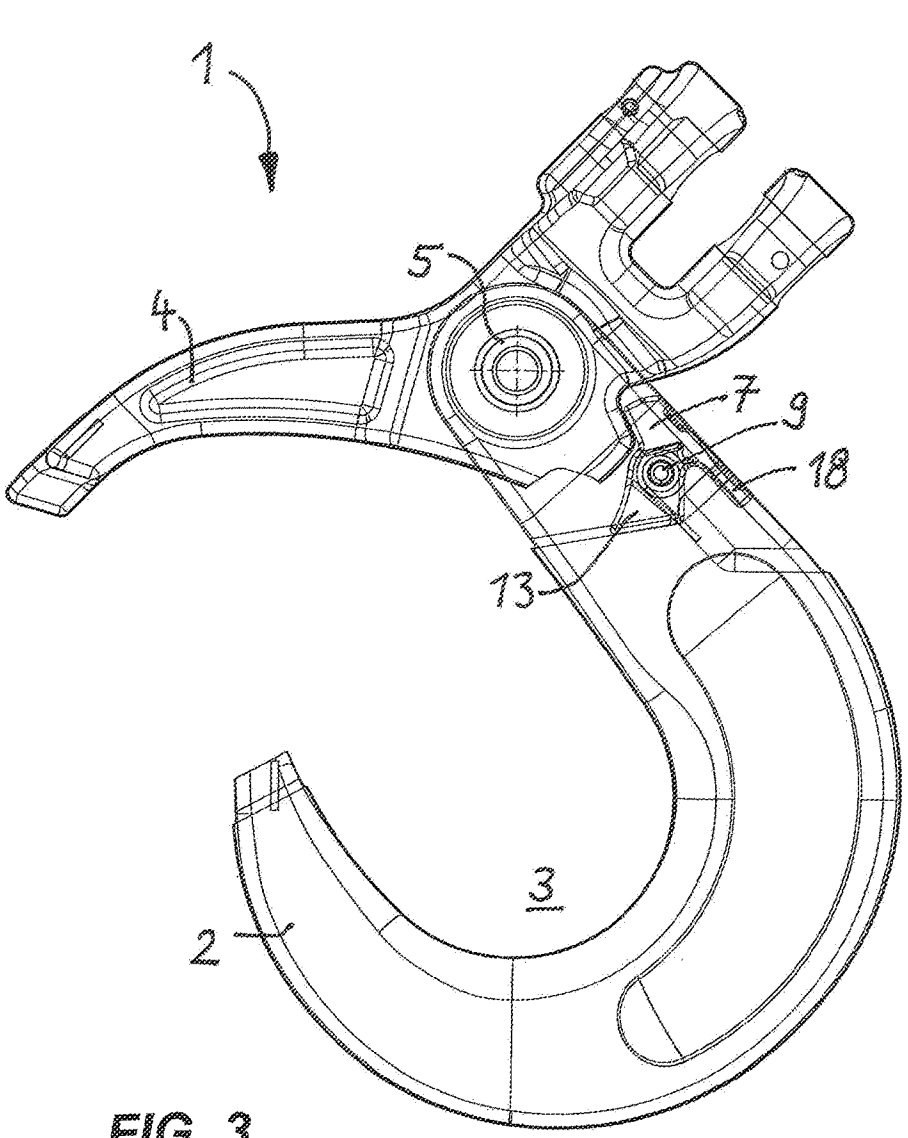
FIG. 3 shows a non-sectioned side view of the load hook from FIG. 2 but in the open state.
Figure 2:
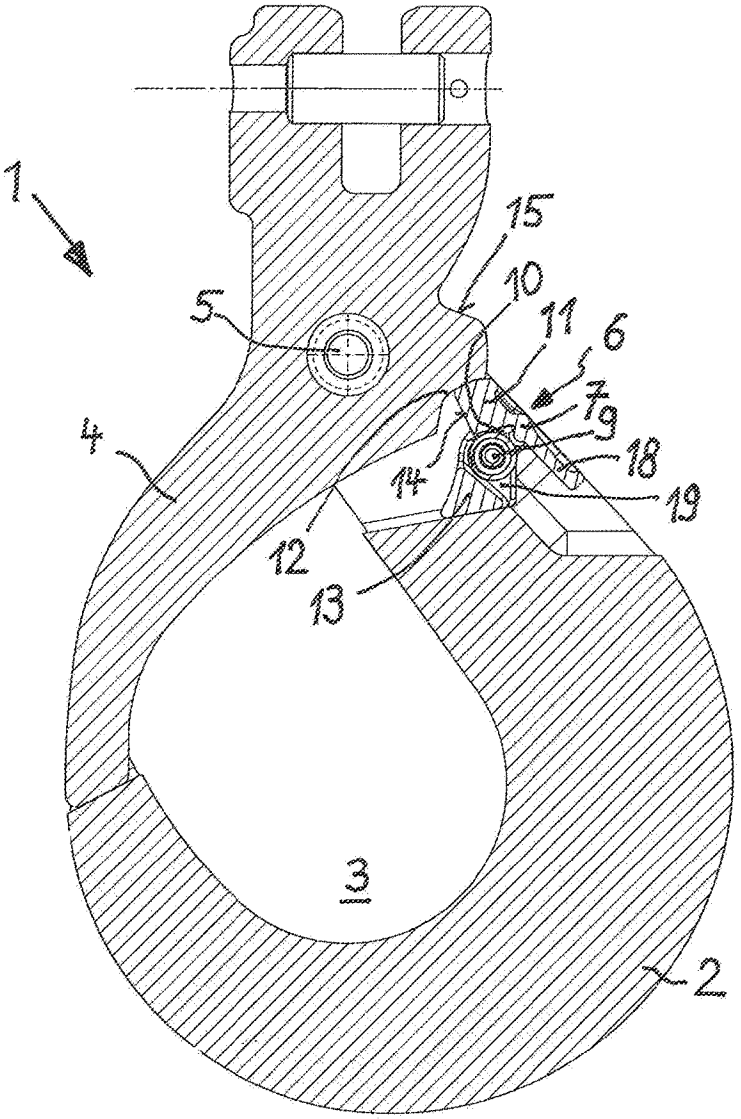
FIG. 2 shows a center section through a safety load hook according to the invention.

Additionally provided is an upper part 4, which is fastened to the lower part 2 so as to be pivotable via a connecting bolt 5 and is provided, in turn, at the top with a suitable connection, such as, for example, a coupling connection (as shown in FIGS. 1 to 3), or an eyelet or a swirl.

Figure 4:
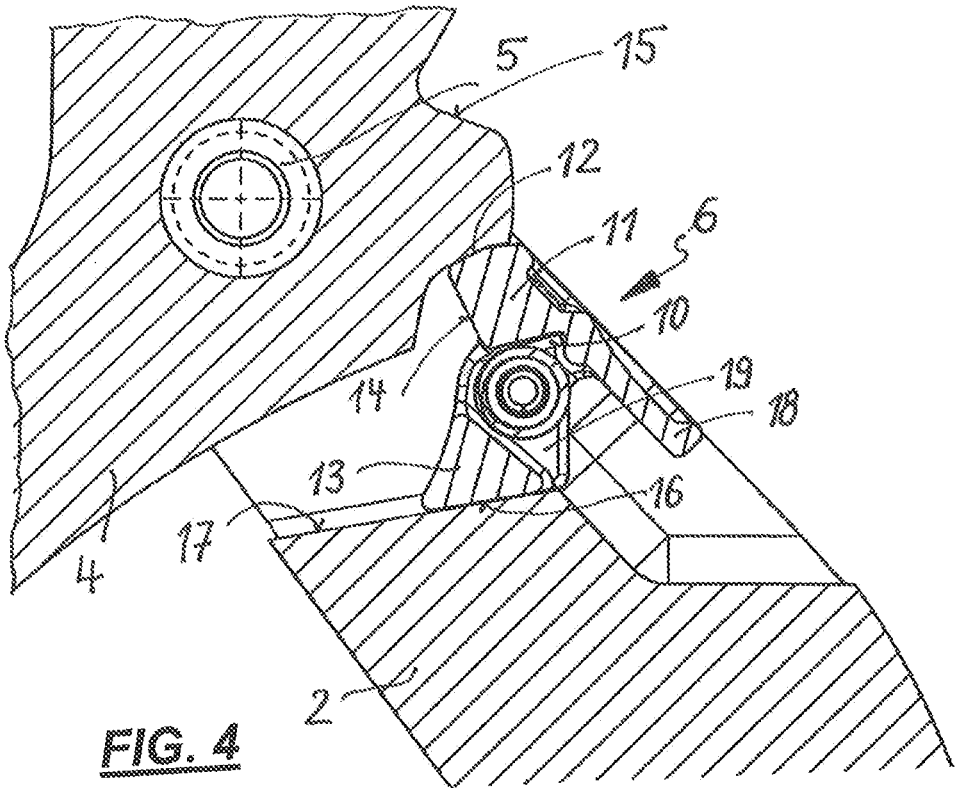
FIG. 4 shows an enlarged sectional representation of the locking arrangement inserted between the upper part and the lower part of a safety load hook according to the invention, as can also be seen from FIG. 2.

The upper part 4 can be moved into a closed position by pivoting, as shown in FIGS. 1 and 4: In said closed position, the hook throat 3 is completely blocked toward the outside (as shown in FIG. 2). Instead of this, however, a small residual gap could still remain in such a manner that in all cases a load suspended in the hook throat 3 is always held securely by the load hook 1 whilst it is being handled and is not able to pass unintentionally outward out of the hook throat 3. Such a residual gap can be up to 3 mm according to EN 818-6.

In order to be able to remove a load received in the load hook 1 from the hook throat 3 again or to be able to suspend a load in the hook throat 3, the upper part 4 of the load hook 1 is pivoted open outwardly about the connecting bolt 5 in relation to the lower part 2, as is shown in the side view in FIG. 3, which also applies in the same way to the safety load hook 1 shown in FIG. 1.

As a result, an inlet opening, which creates the access for inserting or removing a load, is created in the hook throat 3 between the lower part 2 and the upper part 4 of the load hook 1.

A locking arrangement, which is provided overall with the reference symbol 6 and, as shown in FIGS. 1, 2, and 4, includes a pivotable locking lever 7 which is pivotable about a support bolt 9 in relation to the lower part 2 and comprises a receiving bore 8 (cf. FIG. 5), through which the support bolt 9 extends and serves as a pivot axis for the locking lever 7, is arranged between the lower part 2 and the upper part 4 of the load hook 1.

The locking arrangement 6 additionally includes a tensioning spring 10, which, in the locked position of the locking arrangement 6, in which the lower part 2 and the upper part 4 are locked relative to one another with the load hook 1 in the locked position, pretensions the locking lever 7 toward a locked position in which a shaped projection 11, mounted on the locking lever 7, engages in an associated shaped receiving means or receiver 12 on the side of the upper part 4 that faces it, for realizing a latching device.

In the case of the known realization of the locking arrangement 6 shown in FIG. 1, the shaped projection 11 is realized in the form of a small, outwardly projecting lever arm which, on its protruding end, realizes in cross section a V-shaped end surface, by way of which it engages in a shaped receiving means 12 in the form of an indentation, which is realized correspondingly on the facing side of the upper part 4, as a result of which the desired locking is achieved.

The locking lever 7 is pretensioned, in this case, toward its locked position by the pretensioning spring 10 so that when the locked position is reached, as shown in FIG. 1, unwanted releasing of the locking action is avoided.

When, in the case of the known arrangement according to FIG. 1, an excessive opening force then acts on the upper part 4 of the load hook 1 as a result of any incorrect application and the locking arrangement 6 is situated in its locked position, it has certainly been shown in practice that it is definitely possible for the support bolt 9 to shear off on account of the lever action which is exerted via the shaped projection 11 on the locking lever 7 and via said locking lever on the support bolt 9, which results in total failure of the locking action of the locking arrangement 6.

In addition, the arrangement from FIG. 1 can also result in the load hook 1, if it knocks relatively dynamically against a stop in the vertical direction, experiencing an opening torque which acts on said locking lever in the opening direction, is directed in the opposite direction to the pretensioning action of the tensioning spring 10 and exceeds the pretensioning torque thereof as a result of the energy of inertia of the locking lever 7, as a result of which the shaped projection 11 is rotated out of the shaped receiving means 12 and, consequently, once again, the locking action between the upper part 4 and the lower part 2 is cancelled in an unwanted manner.

Figure 5:
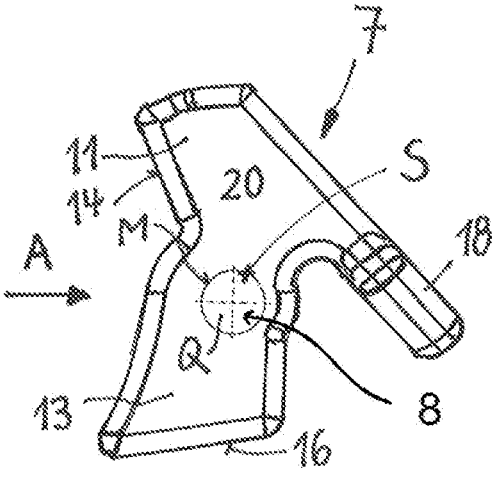
FIG. 5 shows a side view of the locking lever inserted in the locking arrangement according to FIGS. 2 to 4 and FIG. 6 shows a view of the locking lever in FIG. 5 looking in the direction of the arrow A shown there.
Figure 6:
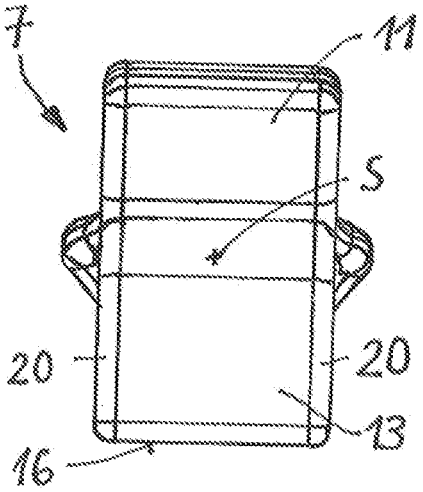

In the case of the embodiment of a safety load hook 1 according to the invention shown in FIGS. 2 to 6, the locking arrangement 6 used there is used in a design that has clearly been modified in relation to that from FIG. 1:

Reference is made first of all to FIGS. 4 to 6 to illustrate the difference in more detail.

These show that here the locking lever 7, on its side located opposite the shaped projection 11 with reference to the receiving bore 8 for the support bolt 9, is provided with a lever portion 13 which realizes a counterweight within the frame of the design of the locking lever 7 in relation to the shaped projection 11 with reference to the receiving bore 8 and in this case is designed such that the mass center point S of the locking lever 7 lies on the lateral surface M of the receiving bore 8, as shown in FIG. 5, or also inside the cross sectional area Q of the receiving bore 8 surrounded by the lateral surface M. In this case, the locking lever 7 should be designed in a quite preferred manner such that, in this case, the mass center point S still lies centrally in the view of the locking lever 7 seen in viewing direction A from FIG. 5, as shown in FIG. 6.

However, during production of such a locking lever 7, it is not always possible to guarantee that the center of mass S, if the position thereof should lie on the lateral surface M of the receiving bore 8, achieves such a position in a precise and exact manner, since, as a result of inevitable manufacturing tolerances in the case of the design thereof, slight deviations can in fact occur thereto in this case, as a result of which the center of mass S also perhaps comes to lie slightly a little outside the lateral surface M, and the formulation that the center of mass S should lie "substantially on the lateral surface M" takes account of this.

Realizing the locking lever 7 such that the center of mass S thereof is to lie substantially on the lateral surface M of the receiving bore 8 or inside the cross sectional area Q of the receiving bore 8 surrounded by said lateral surface M, creates a state which even in the event of the load hook 1 impacting strongly in a vertical manner on a collision element, creates a situation in which the mass moment of inertia of the locking lever 7 then acting suddenly on the center of gravity S is so small that its action in the opening direction of the locking lever 7 is no longer able to overcome the pretensioning action of the same provided by the tensioning spring 10 in the locking direction. This applies quite particularly when (not shown in the figures) the locking lever 7 is designed such that its center of mass S lies on the center axis of the receiving bore 8 or also inside the opening region of the receiving bore 8 surrounded by the lateral surface M.

As can be seen, in particular, from FIG. 3, in the case of the load hook 1 shown, the design of the locking lever 7 and of the end surface of the lower part 2 of the load hook 1 located opposite said locking lever is realized such that the locking lever 7 holds the upper part 4 in the open position thereof even in said open position, by the shaped projection 11 coming to abut here by way of its side flank 14, which is remote from the outside of the safety load hook 1, against an outer contact surface 15 on the outside of the upper part 4 and being held in said abutment contact by the tensioning spring 10, as a result of which the upper part 4 is prevented from pivoting back into the closed position thereof in an unwanted manner. For the corresponding designs of the shaped projection 11 and of the upper part 4, reference is made explicitly to the designs of said parts shown in FIGS. 2 and 3.

The lever portion 13 of the locking lever 7, which is provided on the side of the locking lever 7 located opposite the receiving bore 8 and the support bolt 9, is realized in its design such that it comprises either a free end surface 16 which extends rectilinearly (as shown in the figures) or a weakly curved end surface (not shown in the figures), by way of which it is supported on an associated support counter surface 17 on the lower part 2, as shown in FIGS. 2 to 4.

As said lever portion 13 of the locking lever 7 is located opposite the shaped projection 11 of the locking lever 7 with reference to the rotational axis created by the support bolt 9, even in the case of an extremely strong torque which should act inadvertently on the upper part 4 in the opening direction, rigid support on the lower part 2 is achieved, as seen particularly well in FIG. 4, as a result of the design of the locking lever 7 with the lever portion 13, as a result of which the support bolt 9 is no longer able to shear off and also a large tilt moment of the upper part 4 in relation to the lower part 2 is successfully supported.

In the case of said load hook in FIGS. 2 to 4, the tensioning spring 10 sits inside a recess 19 in the lever portion 13, which is delimited on both sides in each case by a side flank 20 and realizes a type of receiving pocket in which the tensioning spring is held in its assembly position.

To extend the shaped projection 11 in opposite directions, another lever arm 18 is mounted on the locking lever 7, by means of which it is possible to open the locking arrangement 6 from its locked position and, as a result, to release the upper part 4 so that said upper part, as shown in FIG. 3, is able to be rotated into its open position in order to suspend a load in the hook throat 3 of the lower part 2 or to remove a load which is suspended there. In the open state, when the lever arm 18 is released, the tensioning spring 10 presses the shaped projection 11 again by way of its side surface 14 in the direction of the facing side of the upper part 4 until the side surface 14 abuts there against the outer contact surface 15, as a result of which the position shown in FIG. 3 occurs in which the upper part 4 is held in its open position. Said holding position of the upper part 4 can then, as soon as desired, either be cancelled again by actuation of the lever arm 18 or by a somewhat greater closing force which acts on the upper part 4, and the latter can be transferred again into its closed position shown in FIG. 2 in which the locking lever 7 can then also assume its locked position, as shown in FIGS. 2 and 4, under the effect of the tensioning spring 10.

The invention claimed is:

1. A safety load hook, comprising:

a lower part, which defines a hook throat;

an upper part pivotably fastened to the lower part by a connecting bolt, the upper part pivotable to an open position to allow a load to be suspended in the hook throat of the lower part and pivotable to a closed position that blocks the hook throat of the lower part such that an introduction of the load to be received into the hook throat or removal of a load held in the hook throat is prevented, wherein in the closed position, the upper part is blockable in relation to the lower part by a locking arrangement which includes a locking lever with a receiving bore, the locking lever being pivotable about a support bolt arranged in said receiving bore into a release position and into a vertical locked position, is pretensionable into the vertical locked position by a tensioning spring, is fastened to the lower part via the support bolt together with the tensioning spring and is engageable by way of a shaped projection in an associated shaped receiver to the upper part in the locked position, wherein the locking lever includes, at a side opposite the shaped projection with reference to the receiving bore, a lever portion, a center of mass of the locking lever lying substantially on the lateral surface of the receiving bore for the support bolt or inside the cross sectional area surrounded by the lateral surface, and the lever portion comprises a free end surface by way of which it is supported on an associated support counter surface on the lower part in the locked position.

2. The safety load hook as claimed in claim 1, where the center of mass of the locking lever lies on the center axis of the receiving bore for the support bolt.

3. The safety load hook as claimed in claim 1, where the lever portion of the locking lever defines a recess in which the tensioning spring is held in its assembly position.

4. The safety load hook as claimed in claim 3, where the recess of the lever portion is delimited on both sides by a side flank of the lever portion in each case for receiving the tensioning spring.

5. The safety load hook as claimed in claim 4, where the center of mass of the locking lever lies centrally between both side flanks.

6. The safety load hook as claimed in one of claim 1, where the lever portion of the locking lever is supported on an associated counter surface on the lower part in the locked position via a substantially rectilinear or convexly curved end surface on the free end.

* * * * *